US010981717B2

(12) United States Patent
Mahugh et al.

(10) Patent No.: US 10,981,717 B2
(45) Date of Patent: Apr. 20, 2021

(54) PACKAGING PRODUCT FOR PLANAR ITEMS

(71) Applicant: FORNEY INDUSTRIES, INC., Fort Collins, CO (US)

(72) Inventors: Jason T. Mahugh, Windsor, CO (US); James J. Legoza, Fort Collins, CO (US); Samuel Z. Martin, Fort Collins, CO (US); Robin K. Lang, Fort Collins, CO (US)

(73) Assignee: Forney Industries, Inc., Fort Collins, CO (US)

( * ) Notice: Subject to any disclaimer, the term of this patent is extended or adjusted under 35 U.S.C. 154(b) by 132 days.

(21) Appl. No.: 16/509,249

(22) Filed: Jul. 11, 2019

(65) Prior Publication Data

US 2020/0223617 A1 Jul. 16, 2020

Related U.S. Application Data

(60) Provisional application No. 62/792,294, filed on Jan. 14, 2019.

(51) Int. Cl.

| | |
|---|---|
| ***B65D 85/02*** | (2006.01) |
| ***B65D 81/02*** | (2006.01) |
| ***B65D 85/62*** | (2006.01) |
| *B65D 73/00* | (2006.01) |

(52) U.S. Cl.

CPC ..... *B65D 85/02* (2013.01); *B65D 81/02* (2013.01); *B65D 85/62* (2013.01); *B65D 73/0014* (2013.01)

(58) Field of Classification Search

CPC .... B65D 81/02; B65D 73/0014; B65D 85/02; B65D 85/62; B65D 85/58; B65D 85/672; F16B 19/1081; F16B 19/1027; F16B 13/02; F16B 13/04; F16B 13/045; F16B 13/06; F16B 13/063; F16B 13/0858; F16B 13/126; F16B 13/128; F16B 2013/009; G11B 33/0427; G11B 33/045; G11B 33/0444; G11B 33/0461; G11B 17/03; Y10S 411/913; Y10T 24/42; Y10T 29/49948; Y10T 29/49956

USPC ... 206/303, 372, 445, 308.1, 15, 308.2, 310, 206/583, 806, 493, 495; 403/248, 249, 403/254, 255; 411/24, 41, 54, 80.1, 271, 411/954, 363, 923

See application file for complete search history.

(56) References Cited

U.S. PATENT DOCUMENTS 650,208 A * 5/1900 Unser ..... F16B 13/126 411/57.1
793,402 A * 6/1905 Storsberg ..... B26B 13/28 30/270

(Continued)

*Primary Examiner* — Gideon R Weinerth
(74) *Attorney, Agent, or Firm* — Holzer Patel Drennan

(57) ABSTRACT

A packaging product for packaging flat products (e.g., flat stock) such as abrasive articles, e.g., abrasive disks. The packaging product is designed to display flat stock products while maintaining the geometric properties and integrity of the products. The packaging product has a first component that is an engagement member, a second component that is a first retention portion and a third component that is a second retention portion. The engagement member engages with the first and second retention portions to secure a plurality of products between the retention portions.

20 Claims, 9 Drawing Sheets

(56) References Cited

U.S. PATENT DOCUMENTS 1,755,245 A * 4/1930 Amsih ..... F16B 39/286 411/271
2,409,180 A * 10/1946 Annett ..... F16B 19/1036 411/354
2,494,359 A * 1/1950 Roth ..... B42F 5/005 206/310
2,501,037 A * 3/1950 Fox ..... B65D 85/546 294/158
2,549,393 A * 4/1951 Siesel ..... F16B 35/00 411/419
2,968,207 A * 1/1961 Flogaus ..... F16B 19/1081 411/45
3,053,384 A * 9/1962 Loomis ..... B24D 13/08 206/372
3,107,783 A * 10/1963 Corey ..... B65D 85/544 206/310
4,124,118 A * 11/1978 Helm ..... G11B 23/0321 206/310
4,137,680 A * 2/1979 Doonan ..... F16J 13/14 52/302.7
4,233,878 A * 11/1980 McGauran ..... B21H 3/06 411/510
D271,918 S 12/1983 Ramirez
4,499,994 A * 2/1985 Rentch ..... G11B 33/0427 206/0.8
4,588,082 A * 5/1986 Ridings ..... A45C 3/00 206/303
4,883,178 A 11/1989 Thiele et al.
5,135,342 A * 8/1992 Scott ..... F16B 41/005 411/3
5,363,962 A 11/1994 Toral et al.
5,387,065 A * 2/1995 Sullivan ..... F16B 19/1081 411/48
5,456,057 A * 10/1995 Bannon ..... B65D 75/004 53/449
5,613,818 A * 3/1997 McCorkle ..... F16B 21/086 411/509
5,697,496 A * 12/1997 Bauer ..... B65D 85/548 206/308.1
5,713,467 A * 2/1998 Kao ..... B65D 73/0071 206/349
5,906,350 A * 5/1999 Kao ..... A47F 7/0028 248/688
6,112,894 A * 9/2000 Kikuchi ..... G11B 33/045 206/303
6,123,492 A * 9/2000 Pickard ..... B65D 19/0095 411/339
6,161,689 A 12/2000 Reithel
6,273,656 B1 * 8/2001 Cleland ..... F16B 19/1081 411/45
6,427,832 B1 8/2002 Ali et al.
6,729,468 B1 5/2004 Dobmeier
7,357,249 B1 * 4/2008 Weber ..... G09F 3/02 206/308.1
7,997,410 B2 8/2011 Ali et al.
2002/0079243 A1 * 6/2002 Ali ..... B65D 73/0092 206/303
2002/0175097 A1 * 11/2002 Hai ..... G11B 33/0427 206/310
2002/0195409 A1 * 12/2002 Ku ..... G11B 33/0444 211/40
2003/0132126 A1 * 7/2003 Parrotta ..... G11B 33/0427 206/310
2004/0031708 A1 * 2/2004 Spagna ..... G11B 33/0427 206/308.2
2007/0193897 A1 * 8/2007 Kinoshita ..... G11B 33/045 206/308.1
2008/0031703 A1 * 2/2008 Nakajima ..... F16B 19/1081 411/363
2015/0176621 A1 * 6/2015 Lee ..... F16B 19/1027 411/57.1
2020/0223617 A1 * 7/2020 Mahugh ..... B65D 81/02

* cited by examiner

PACKAGING PRODUCT FOR PLANAR ITEMS

CROSS REFERENCE TO RELATED APPLICATION

This application claims priority under 35 U.S.C. § 119(e) to U.S. provisional application 62/792,294, filed Jan. 14, 2019, the entire disclosure of which is incorporated herein by reference for all purposes.

BACKGROUND

One form of abrasive article (e.g., sandpaper) is a disk, which is typically used for grinding, often using a motorized sander, grinder or other tool. The disk is usually mounted on a rigid support pad that is rotatably connected to the tool. These types of abrasive articles typically have a backing with at least one layer of abrasive particles adhered to the backing with a binder, usually polymeric binder. The backing is often paper, polymeric material(s), cloth, nonwoven materials, vulcanized fiber, or combinations of these materials, depending on the intended application of the disk.

While a vulcanized fiber disk is highly desired due to the durability of the backing, particularly under high pressure and high temperature grinding applications, this disk is very susceptible to warping. A main disadvantage of the vulcanized fiber disk is that it is relatively hygroscopic and sensitive to humidity and is thus affected by water absorption or loss. Consequently, a vulcanized disk will warp or curl, typically with the abrasive coated side convexly outward. Once curled, the disk does not lay flat against the support pad and when trying to flatten the disk, it is subject to breaking as it is typically very brittle. This warping often occurs while on the shelf in the store or once opened from the package. This is a significant problem.

SUMMARY

Provided herein is a solution to warping and curling disks. Specifically, described herein is a packing system for use with abrasive disks and other planar products, the packing system supporting the sides of the products to inhibit warping, curling, and other deformation.

In one particular implementation, a packaging product is described, the product having a first retention portion having a first receiver hole, a second retention portion having a second receiver hole, and an engagement member configured to be received within the first receiver hole and the second receiver hole, to retain the first retention portion with the second retention portion.

In another particular implementation, another packaging product is described, the product having a first planar retention portion having a first receiver hole, a second planar retention portion having a second receiver hole, and an engagement member configured to be received through the first receiver hole and the second receiver hole. The engagement member has a flange having a diameter greater than the receiver holes and has a non-threaded engagement with the first planar retention portion and the second planar retention portion.

In another particular implementation, another packaging product is described, the product having a first planar retention portion having a first receiver hole, a second planar retention portion having a second receiver hole, and an engagement member configured to be received through the first receiver hole and the second receiver hole. The engagement member has a flanged base having a diameter greater than the receiver holes and with a toothed shaft extending from the base.

In yet another particular implementation, a packaging product is described that has a first planar retention portion and a second planar retention portion. The first planar retention portion has a hollow engagement member shaft centered thereon and extending perpendicularly therefrom, the engagement member shaft configured to be received through a receiver hole in the second planar retention portion, the engagement member shaft having a non-threaded engagement with the second planar retention portion.

Also described are packaged products, having at least one flat stock item (e.g., a sanding disk) packaged between the first retention portion and the second retention portion, with the flat stock item having a hole through which the engagement member passes.

This Summary is provided to introduce a selection of concepts that are further described below in the Detailed Description. This Summary is not intended to identify key features or essential features of the claimed subject matter, nor is it intended to be used to limit the scope of the claimed subject matter. These and various other features and advantages will be apparent from a reading of the following Detailed Description.

BRIEF DESCRIPTIONS OF THE DRAWING

The described technology is best understood from the following Detailed Description describing various implementations read in connection with the accompanying drawing, where:

Figure 4A:
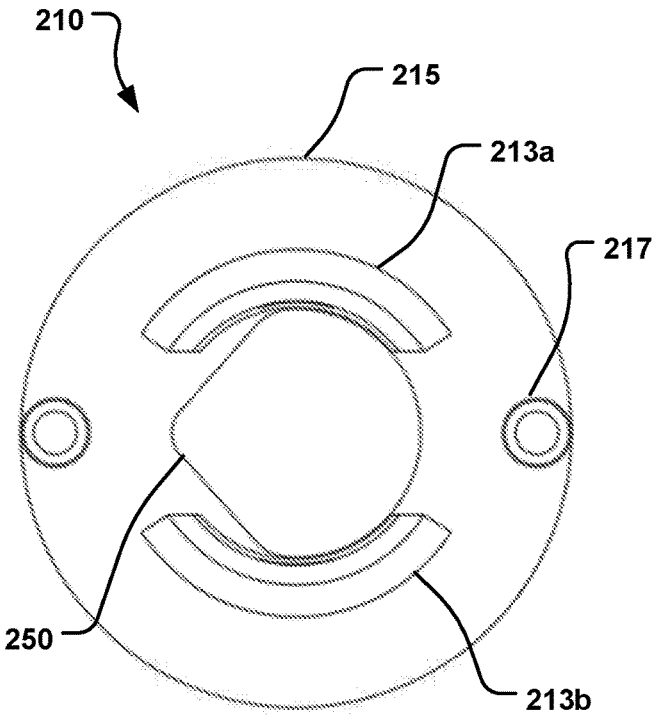
Figure 4B:
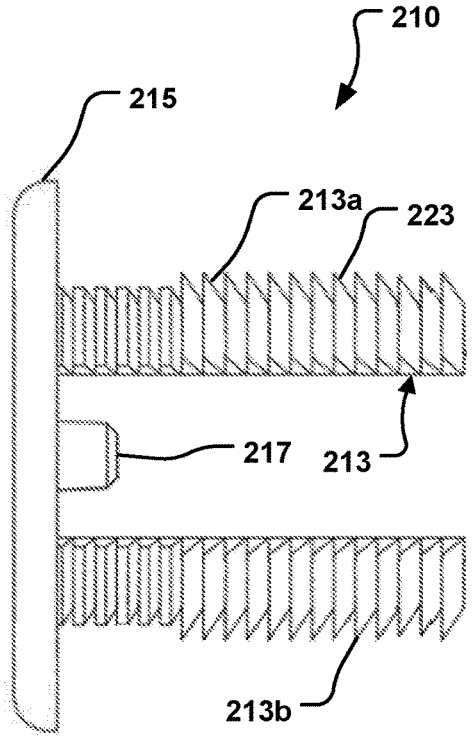
Figure 4C:
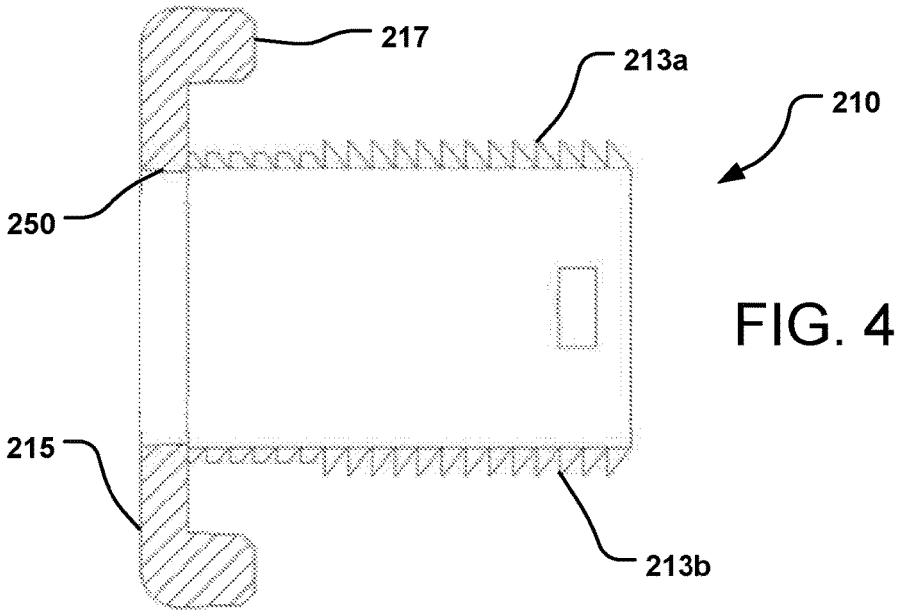

FIG. 4A is a front plan view of an example engagement member; FIG. 4B is a side view of the engagement member; FIG. 4C is cross-sectional side view of the engagement member.

Figure 5:
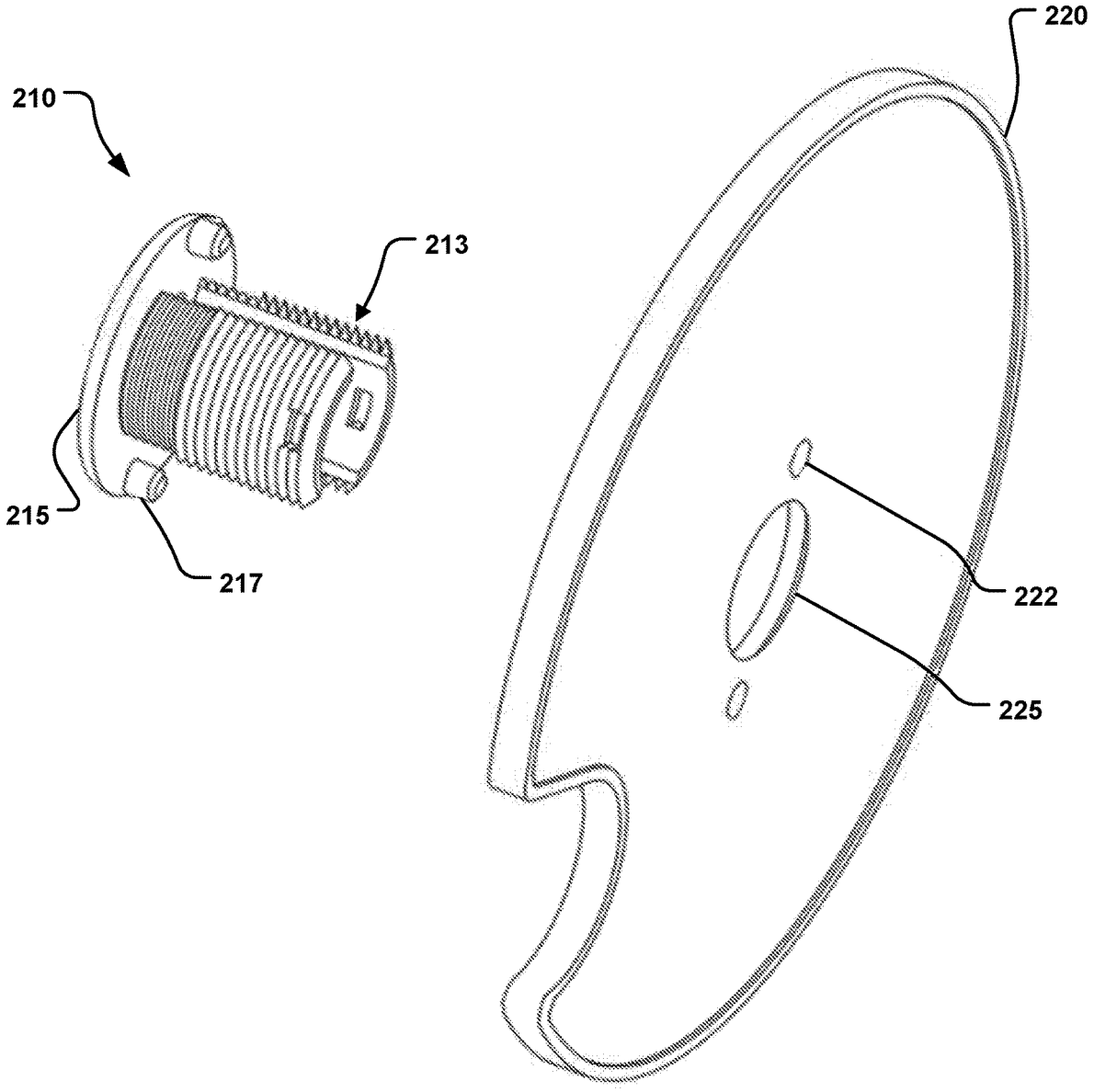

FIG. 5 is a side perspective view of an engagement member and a retention portion of a packaging product.

Figure 6:
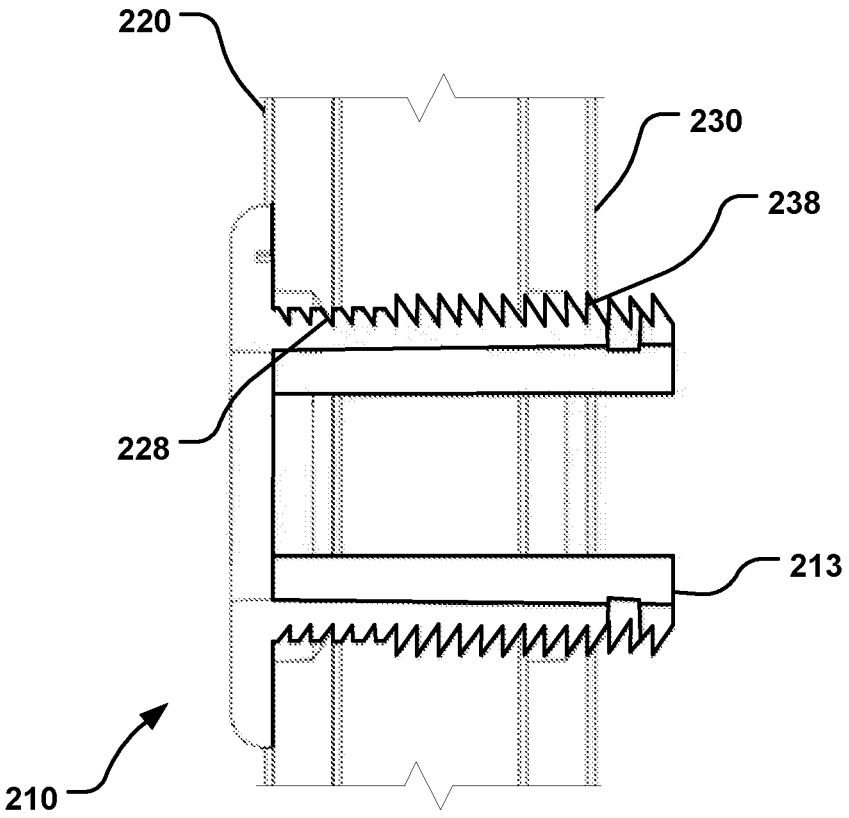

FIG. 6 is a cross-sectional side view of an engagement member engaged with two retention portions.

Figure 7:
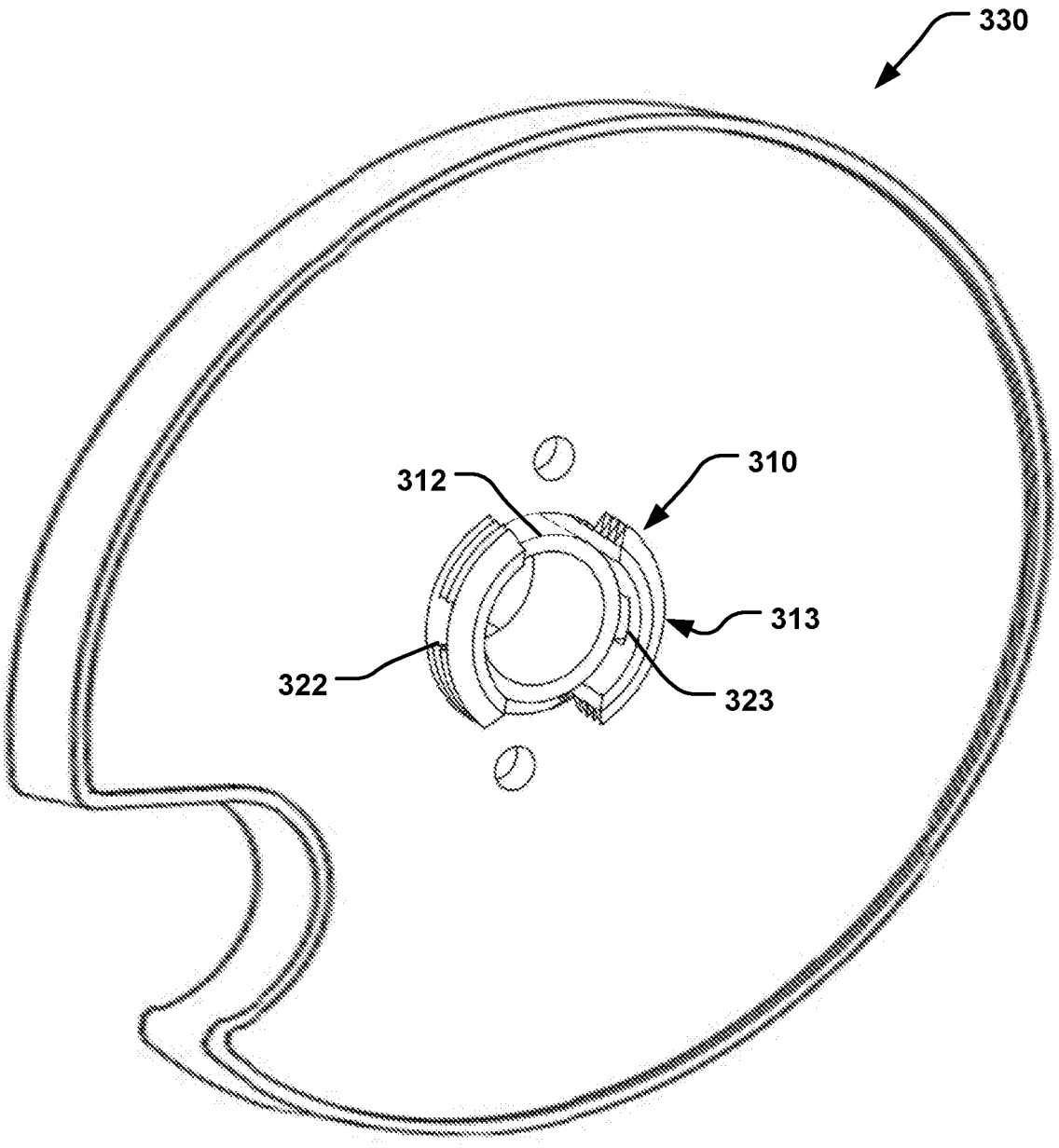

FIG. 7 is a perspective view of an example engagement member.

Figure 8A:
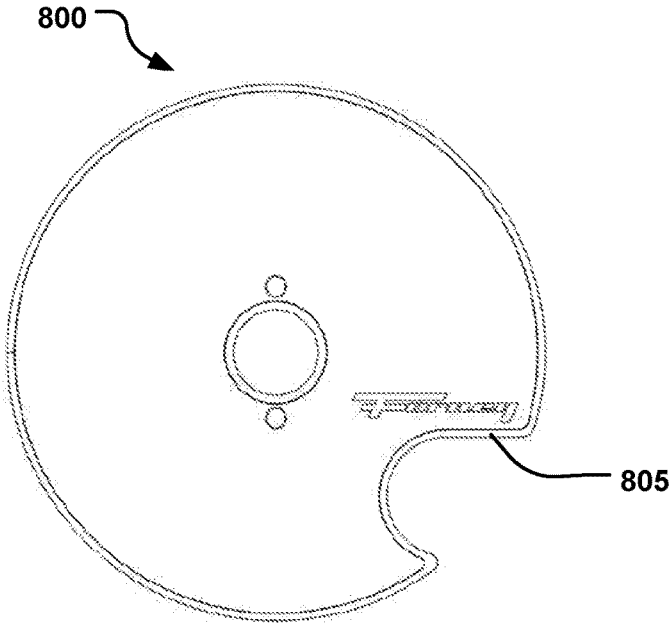
Figure 8D:
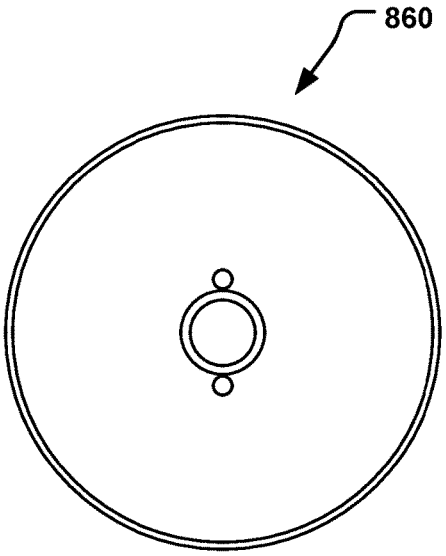
Figure 8B:
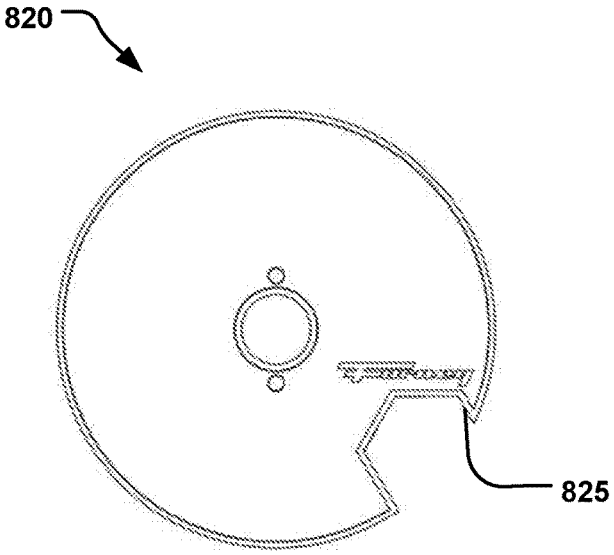
Figure 8C:
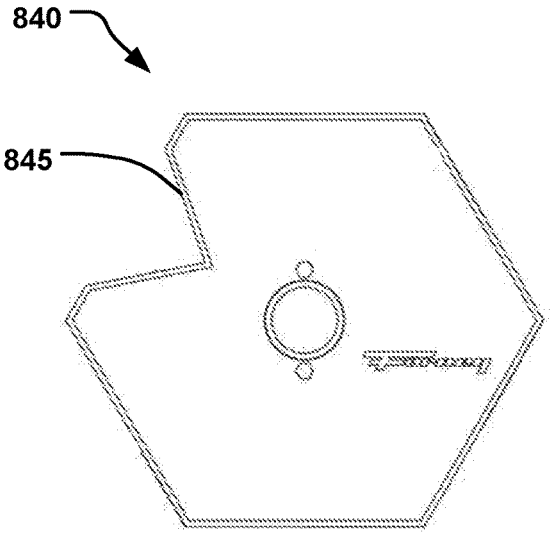

FIG. 8A is front plan view of an example retention portion; FIG. 8B is front plan view of another example retention portion; FIG. 8C is front plan view of another example retention portion; and FIG. 8D is a front plan view of yet another example retention portion.

Figure 9:
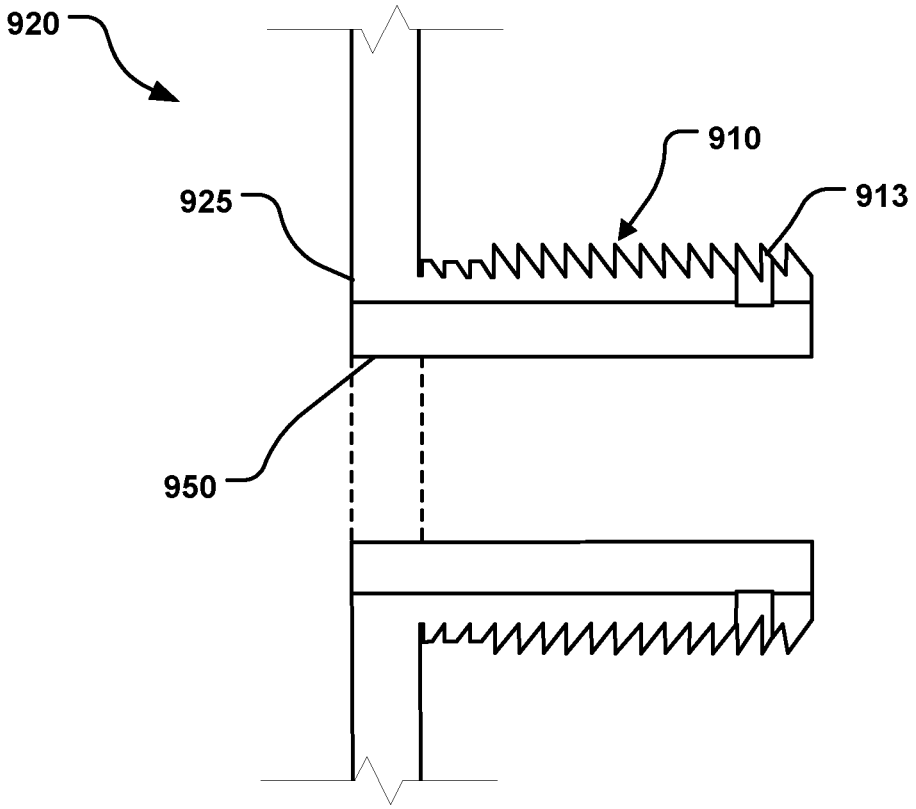

FIG. 9 is a cross-sectional side view of a retention portion having an integral engagement member.

DETAILED DESCRIPTION

As described in more detail below with respect to the figures, the disclosed technology is directed toward a packaging product for packaging flat products (e.g., flat stock) such as abrasive articles, e.g., abrasive disks.

The packaging product is designed to display (e.g., hold, present, store, hang) flat stock products while maintaining the geometric properties and integrity of singular or multiple flat stock products, e.g., plate, cylindrical, sheet or disc-like products. Each of the products retained by the packaging product has a cut out or aperture to receive an engagement member of the packaging product, about which the products will be aligned and stacked. The cut out may have any geometry suitable to receive the engagement member therethrough.

In the following description, reference is made to the accompanying drawing that forms a part hereof and in which is shown by way of illustration at least one specific implementation. The following description provides additional specific implementations. It is to be understood that other implementations are contemplated and may be made without departing from the scope or spirit of the present disclosure. The following detailed description, therefore, is not to be taken in a limiting sense. While the present disclosure is not so limited, an appreciation of various aspects of the disclosure will be gained through a discussion of the examples, including the figures, provided below. In some instances, a reference numeral may have an associated sub-label consisting of a lower-case letter to denote one of multiple similar components. When reference is made to a reference numeral without specification of a sub-label, the reference is intended to refer to all such multiple similar components.

Figure 1A:
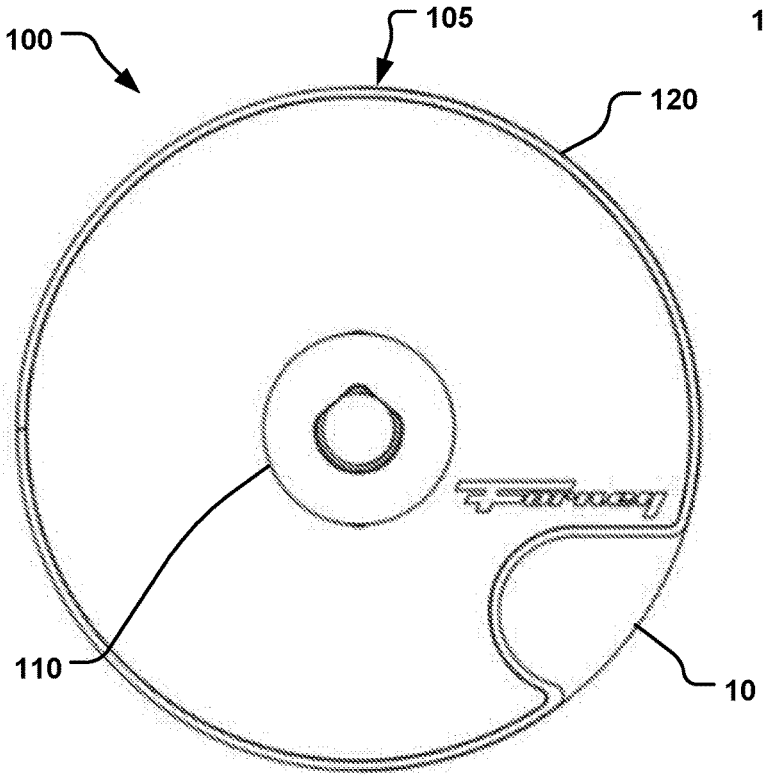
FIG. 1A is a front plan view of an example disk package having a packaging product of this disclosure retaining therein a plurality of disks.
Figure 1B:
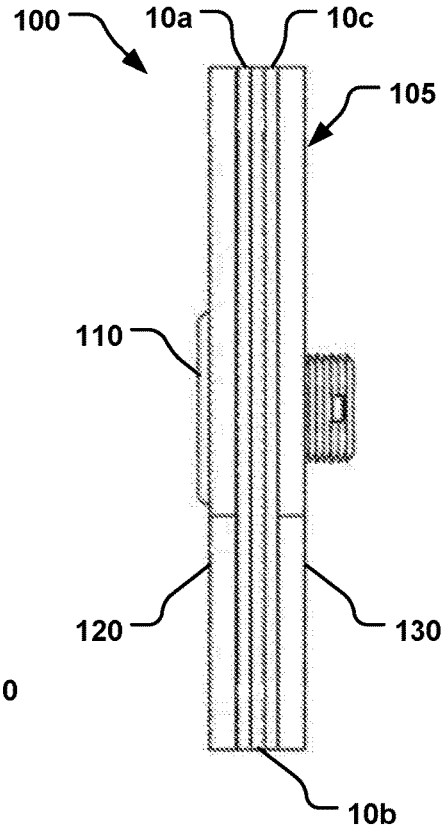
FIG. 1B is a side plan view of the packaged disk product.
Figure 1C:
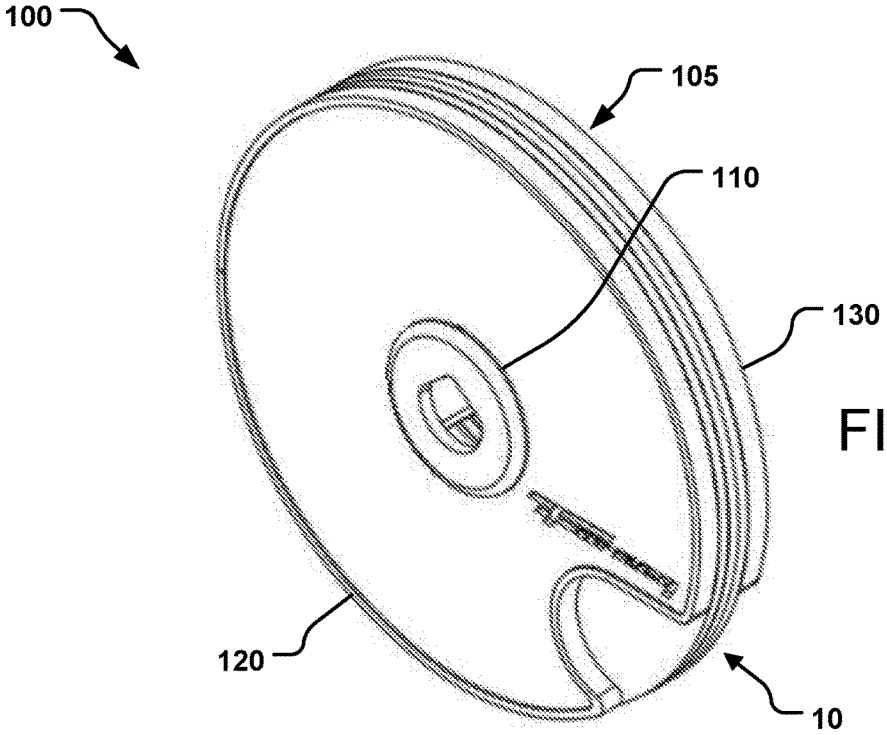
FIG. 1C is a side perspective view of the packaged disk product.

FIGS. 1A, 1B and 1C illustrate a packaged product, composed of a packaging product (seen in FIG. 2B as 105) having a plurality of flat stock products retained therein. Particularly, FIGS. 1A, 1B, 1C are, respectively, a front plan view, side plan view, and ¾ isometric or perspective view of a packaged product comprising at least one product (e.g., sanding disk) retained by a packaging product. The packaged product may be a packaging unit or may be a partial packaging unit; as an example, a packaging unit may be sold having 5 disks, which after removal of 2 disks, remaining is a packaged product.

The packaged product 100 includes a packaging product 105 that has a first component that is an engagement member 110, a second component that is a first retention portion 120 and a third component that is a second retention portion 130. The engagement member 110 engages with the first and second retention portions 120, 130 to secure at least one product 10 between the retention portions 120, 130. The packaging product 105 can retain therein a plurality of products (e.g., sanding disks) to provide the packaged product 100. In the particular implementation shown in FIGS. 1A, 1B and 1C, a plurality of products 10, particularly product 10*a*, product 10*b* and product 10*c*, is present between the retention portions 120, 130. The packaging product 105 is particularly conducive to holding and storing products that are or should be planar (e.g., they have a propensity to distort in shape).

Each of the retention portions 120, 130 is overall flat or planar or essentially flat or planar and has a shape and size approximating the shape and size of the product(s) 10. In many implementations, the retention portions 120, 130 are circular, particularly when the product(s) 10 are circular. Alternately, in some implementations, the retention portions 120, 130 are non-circular (e.g., hexagonal, pentagonal) when the product(s) 10 are circular.

The retention portions 120, 130 may have various ornamental or identifying features that extend up from the body of the retention portion 120, 130; thus, the overall shape of the retention portions 120, 130 is (e.g., essentially) flat or planar. The two retention portions 120, 130 may be identical, thus allowing interchangeability between the two. Additional details regarding the shape and size of the retention portions 120, 130 and the packing product 105, in general, are provided below.

Figure 2A:
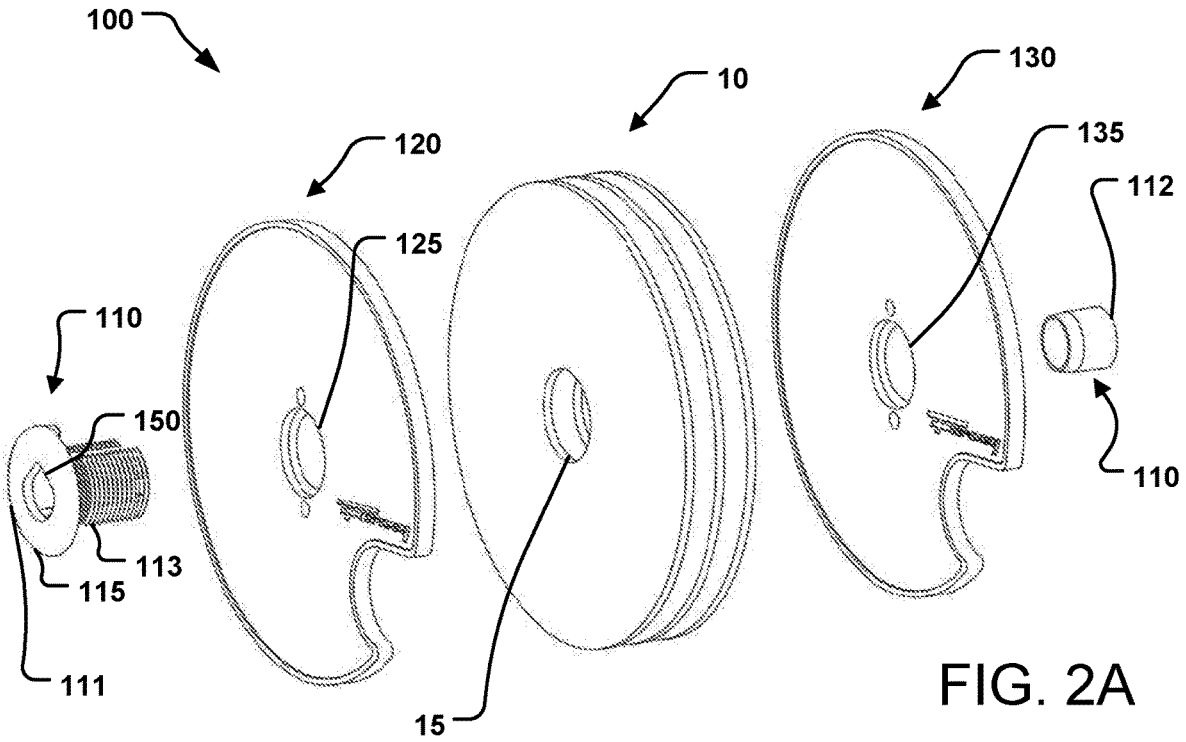
FIG. 2A is a side perspective view of an exploded packaged disk product, showing individually the packaging product and the plurality of disks.
Figure 2B:
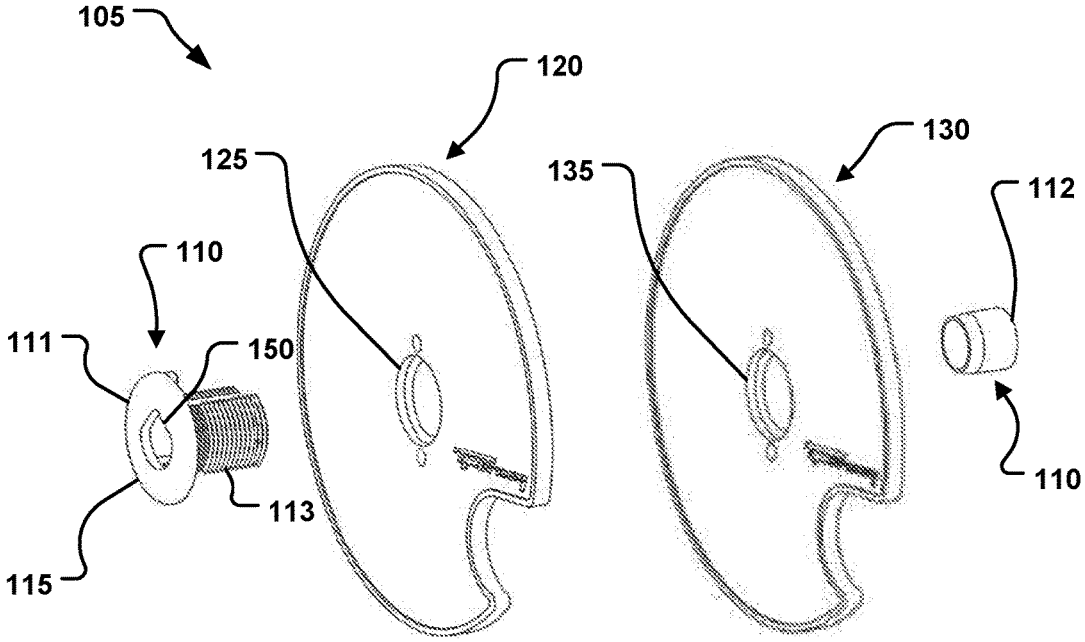
FIG. 2B is a side perspective view of an exploded packaging product.

FIGS. 2A and 2B show the various elements of the packaged product 100 of FIGS. 1A, 1B, and 1C in an exploded view and also show the various elements of the packaging product 105 without the retained products (e.g., sanding disks). FIGS. 2A and 2B show the engagement member 110, the first retention portion 120, at least one planar product 10, and the second retention portion 130. The engagement member 110, in this implementation, has two engaging pieces or parts, a bolt-like member 111 and a locking or security member 112.

The engagement member 110 includes the engaging bolt-like member 111 and the security member 112. The bolt-like member 111 has a shaft 113 terminating at one end with an increased radiused end, in this implementation, a flat, washer-type base 115 having a flanged diameter greater than the diameter of the shaft 113. The base 115 is configured to seat against the first retention portion 120 and provide an increased surface area to engage the first retention portion 120.

In the implementation of FIGS. 2A and 2B and also FIG. 3, the base 115 has an aperture or opening 150 therethrough, the aperture 150 leading to a slot through the shaft 113, which is further detailed below. Although the aperture 150 in the base 115 may be any shape, e.g., circular, square, oval, etc., a self-centering, self-aligning and/or self-orientating shape improves the displayability of the packaging product 105 and packaged product 100, e.g., when hung on a display.

Figure 3:
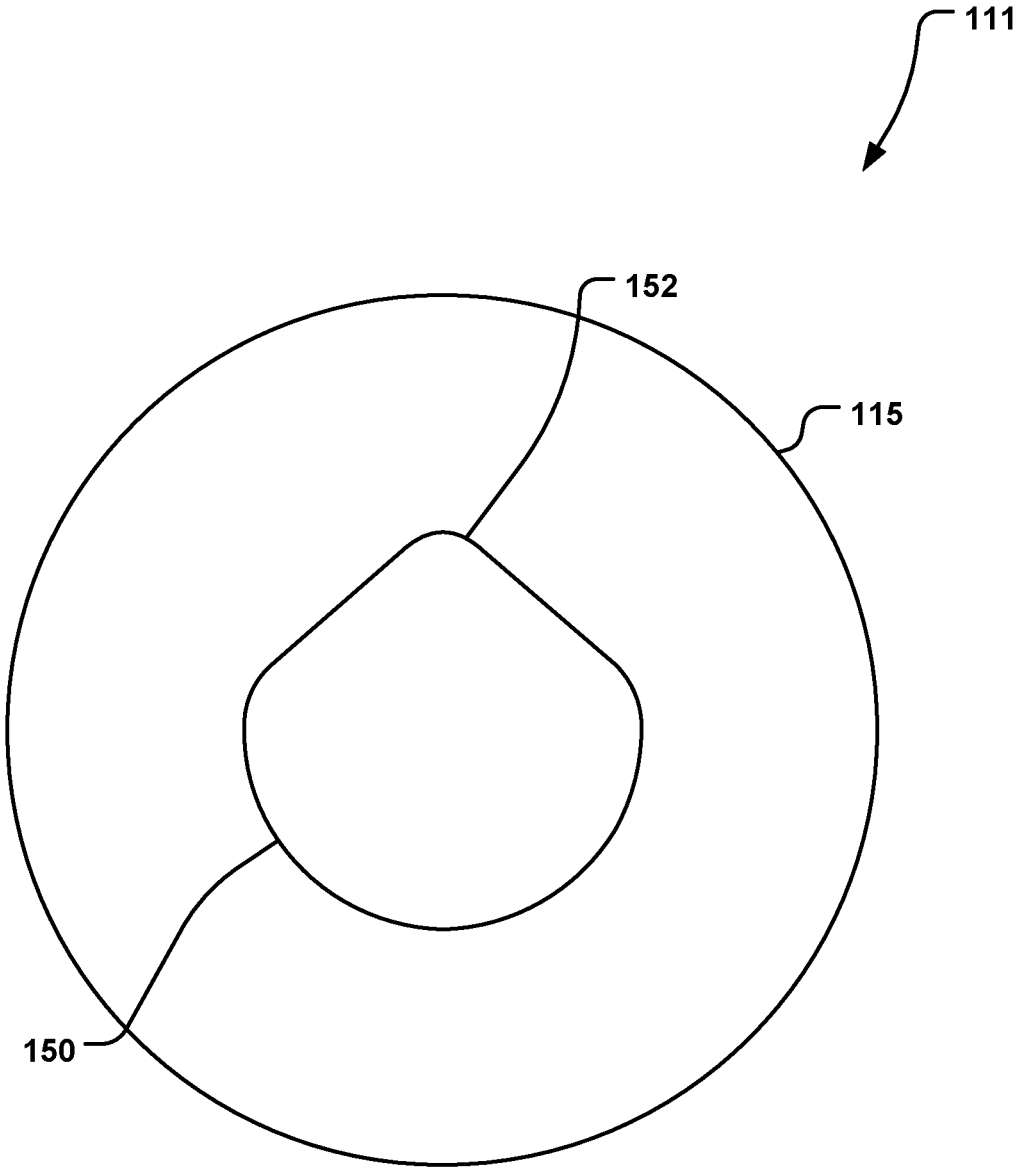
FIG. 3 is a schematic diagram of an engagement member part of a packaging product.

Best seen in FIG. 3, the aperture 150 in the base 115 of the bolt-like member 111 can receive a hanging hook, wire, or other display element therethrough. The particular aperture 150 has a self-centering, self-aligning and/or self-orientating feature 152 that facilitates directional alignment and orientation of the packaging product 105 and packaged product 100, e.g., when displayed on a rack in a hanging manner; an alternate aperture may not have such a self-centering or self-aligning feature. The feature 152 may be symmetrical or not. As the packaging product 105 or packaged product 100 is installed on a variety of hanging hook styles, the feature 152, in this implementation a tapered concavity, assisted by gravity, will align the hanging hook in the feature 152 and thus aperture 150 in the bolt-like member 111. The feature 152 allows movement, e.g., swaying, of the packaging product 105 and packaged product 100 on the hook but the packaging product 105 and packaged product 100 returns to the intended hanging position if there is no external interference. In some implementations, the feature 152 may be more narrow, such as a key way or slot, which would further stabilize the orientation of the packaging product 105 and packaged product 100 on a display hook.

Returning to FIGS. 2A and 2B, the retention portions 120, 130 include an aperture or hole 125, 135, respectively, to receive at least a portion of the engagement member 110 therethrough. The product 10 also has an aperture or hole 15 therethrough, to receive the portion of the engagement member 110.

FIGS. 4A, 4B, 4C, 5 and 6 show an example engagement member 210 that can be used alone or with a second member (e.g., such as security member 112 of FIGS. 2A and 2B).

The engagement member 210 has many similar features to the bolt-like member 111 of the engagement member 110 of FIGS. 1 through 3. The engagement member 210 has a shaft 213 terminating at a generally flat base 215 that has a diameter greater than the diameter of the shaft 213. The shaft 213 has two portions, 213*a,* 213*b,* each being a semi-circle or arc, connected to the back side of the base 215; the portions 213*a,* 213*b* can be described as cantilevered from the base 215. Each portion 213*a,* 213*b* occupies about 90 degrees of a circle (about a 90 degree arc) and the two portions 213*a,* 213*b* are evenly spaced. In alternate implementations, the shaft 213 may have any number of portions (e.g., three or four), each which occupies more or less than 90 degrees, and that may be evenly spaced or not. The portions 213*a,* 213*b* are rigid yet slightly flexible, bendable or otherwise deformable in relation to the base 215; particularly, the distal ends of the portions 213*a,* 213*b* can be moved at least slightly inward towards each other and then elastically return to their original orientation.

Best seen in FIG. 4B, each shaft portion 213*a,* 213*b* has a mechanical grip interface, such as a plurality of serrations or teeth 223, on the outer or peripheral surface. In the particular implementation shown, the teeth 223 proximate the distal end of the shaft 213 are taller and/or wider than the teeth proximate the base 215; in alternate implementations, the teeth 223 may be the same height and/or width along the length of the shaft 213 or the teeth 223 proximate the distal end of the shaft 213 may be shorter and/or narrower than the teeth proximate the base 215. Additionally, the teeth 223 proximate the distal end have a pointed or angled tip, whereas the teeth 223 proximate the base 215 are blunt or truncated. The pointed or angled teeth have a sloped surface facing the distal end of the shaft 213 and a back surface facing the base 215 that is orthogonal to the direction of the shaft 213; such a shape of the teeth 223 facilitates moving a retaining portion 120, 130 onto the shaft 213 (in a right to left direction in FIG. 4B, from the distal end toward the base 215) yet inhibits removing the retaining portion 120, 130 from the shaft 213 (in a left to right direction in FIG. 4B, from the base 215 toward the distal end).

Similar to the bolt-like member 111 of the first example, the base 215 has a self-centering, self-aligning and/or self-orientating shaped aperture 250 extending through the base 215; again, alternate implementations may not have a self-centering, self-aligning and/or self-orientating shaped aperture.

The base 215 also includes at least one alignment guide 217 extending from the base 215 to facilitate and maintain the alignment of the engagement member 210 with a retention portion 220 (FIG. 5). The alignment guide 217 is a bump, extrusion, or other protuberance extending from the base 215 along the direction of the shaft 213, optionally parallel to the shaft 213. The end of the alignment guide 217 can be beveled, tapered and/or rounded. In this particular example, the base 215 has two alignment guides 217 evenly spaced on the back of the base 215. In alternate implementations, the base 215 may have three or four alignment guides 217, that may be evenly spaced or not. The alignment guide 217 aligns with a guide receptacle 222 present in the retention portion 220, close to an aperture or hole 225, through which the shaft 213 of the engagement member 210 fits. The guide receptacle 222 may be a hole or aperture through the retention portion 220 or may be an indent or recess into which the alignment guide 217 fits. There should be enough guide receptacles 222 to receive all of the alignment guides 217. In some implementations, the retention portion includes no such alignment guides.

In an alternate implementation, the alignment guide and the guide receptacle may be switched, so that the protruding alignment guide is on the retention portion and the guide receptacle is on the engagement member (e.g., on the base).

To retain two retention portions together with product (e.g., flat stock) therebetween, such as shown in FIGS. 1A, 1B, and 1C, to create a packaged product, the engagement member 210, particularly the shaft 213, is passed (e.g., pushed or pressed) through the hole 225 in the retention portion 220 until the back of the base 215 seats against the retention portion 220. The force used to push the shaft 213 through the hole 225 also exerts a force (normal to the face of each tooth 223) on the distal end of the shaft 213 forcing the shaft 213 to flex inward, decreasing the diameter of the shaft 213 to the extent that the teeth 223 no longer inhibit the axial motion of the retention portion 220 onto the shaft 213.

Any number of products (e.g., products 10) having a hole therein are placed on to the shaft 213, after which a second retention portion 220 is placed on the shaft 213, thus sandwiching the products between two retention portions 220. FIG. 6 shows the engagement member 210 with the shaft 213 passed through and engaged with two retention portions 220, 230 and the base 215 of the engagement member 210 seated against the retention portion 220. The engagement connection between the shaft 213 of the engagement member 210 and the retention portions 220, 230 is a snap-on, snap-fit or non-threaded engagement; the teeth 223 implement the snap engagement.

The teeth 223 also inhibit the retention portions 220, 230 from being removed from the shaft 213 of the engagement member 210, however, pinching the two portions 213*a,* 213*b* of the shaft 213 together decreases the overall diameter of the shaft 213 thus allowing the shaft 213 to be removed from the hole 225. A tooth-engaging feature 228, 238 may be present in the side surface of the hole 225 of the retention portion 220, 230 to increase the engagement between the teeth 223 on the shaft 213 and the retention portion 220, 230.

Once the engagement member 210 is fully inserted into the retention portions 220, 230, rotation of one or more components in respect to the others may occur. However, the engagement member 210 cannot be removed from the retention portions 220, 230 without deliberate action, such as pinching the two portions 213*a,* 213*b* of the shaft 213 of the engagement member 210.

For implementations having the tooth-engaging feature 228, 238, movement of the toothed shaft 213 in relation to the retention portions 220, 230 may be limited to one tooth 223 at a time, e.g., step-wise movement. For example, the retention portion 220, 230 moves down the shaft 213 (from the distal end to the base 215) by the distance of only one tooth 223, because the next tooth 223 along the shaft 213 will re-engage the tooth-engaging feature 228, 238 of the retention portion 220, 230; this process will repeat tooth by tooth until the front face of the retention portion 220 is coincident with the back of the base 215 of the engagement member 210.

Because the shaft 213 of the engagement member 210 will exhibit a greater resistance to deformation near the base 215 than at the distal end, the teeth 223 closer to the base 215 may be, e.g., truncated or otherwise shorter, or more flexible or distortable, to ease the installation of the retention portion 220 onto the shaft 213 proximate the base 215.

To lock the shaft 213 and inhibit removal of the shaft 213 from the retention portions 220, 230, a security member (e.g., member 112 of FIG. 2A) may be inserted into the shaft 213 to inhibit the shaft portions 213*a,* 213*b* from being compressed.

An alternate locking mechanism is illustrated in FIG. 7, which shows an engagement member 310 having a shaft 313 seated within an aperture in a retention portion 330. A security member 312 is positioned within the shaft 313 to inhibit the shaft 313 from being compressed. Both the shaft 313 and the security member 312 include a passage 323, 322, respectively, therethrough. When the passages 322, 323 are aligned, a fastener such as a zip-tie may be secured therethrough, to ensure the security member 312 cannot be removed from the shaft 313.

It is to be understood that the retention portions, e.g., 120, 130, 220, etc., may be any shape suitable to engage with and hold flat stock that is being retained by the retention portions; the retention portions are essentially planar or flat. FIGS. 8A, 8B, 8C, and 8D show four alternate implementations of retention portions. In FIG. 8A, a circular retention portion 800 is shown, having an arcuate product inspection zone 805; in FIG. 8B, a circular retention portion 820 is shown, having a hexagonal product inspection zone 825; in FIG. 8C, a hexagonal retention portion 840 is shown, having a triangular product inspection zone 845; and in FIG. 8D, a smaller circular retention portion 860 is shown, having no product inspection zone.

The product inspection zone 805, 825, 845 is an area where a notch or other shape has been removed from the retention portion to act as a product inspection zone, allowing visual and manual inspection of the product that is adjacent to (e.g., behind) the retention portion. The product inspection zone, if present, can be in any location in or on the retention portion and have any shape and or/size, but is readily formed at a peripheral or circumferential edge of the retention portion, as shown in FIGS. 8A through 8C. If an inspection zone is present in or on both retention portions (e.g., 120 and 130), when the retention portions are incorporated into a packaging product or packaged product, the zones may or may not align from one retention portion to the other, and may or may not be the same shape and/or size.

Any or all of the components of the packaging product 105 may be made from, e.g., polymeric or plastic material, these components including the retention portions 120, 130, 220, etc., and the engagement member 110, 210, etc. Other rigid materials, such as wood, metal, ceramic, etc., could be used, however polymeric or plastic material is typically the least expensive and is readily formed (e.g., molded, pressed) into the desired shape.

The retentions portions 120, 130, 220, etc. have a size (e.g., diameter) sufficient to cover at least 10% of the surface area of the product(s) retained thereby, in some implementations at a higher percentage (e.g., 50%, 90%, 95%), and in other implementations the entire surface area of the product (s) retained thereby. In fact, the retentions portions 120, 130, 220, etc. may have a size (e.g., diameter) greater than the product(s), for example, greater than by a few mm. Common sizes for sanding disks include 4 inches, 4 ½ inches, 5 inches, 7 inches, 8 inches and 9 inches; thus, the retentions portions 120, 130, 220, etc. have a variable size, typically similar to the product to be retained thereby.

The thickness of the retention portions 120, 130, 220, etc., is such that the portions are sufficiently rigid to withstand the curling forces of the disks or other planar products and maintain a flat or planar orientation, to thus keep any product(s) retained thereby similarly flat. The thickness may be, e.g., at least 2 mm and no more than 10 mm (1 cm); about 4 mm or 5 mm, and 4-5 mm, are specific examples of suitable thicknesses.

In an alternate implementation of the separate retention portions and engagement member described above, the engagement member may be integral with or otherwise permanently affixed to the first retention portion. In such an implementation, e.g., a toothed shaft, e.g., formed by two portions, is adhered to, molded with, or otherwise connected to a retention portion, the retention portion thus not needing an aperture or hole for receiving the engagement member shaft therethrough. A second retention portion would have an aperture or hole for receiving the engagement member shaft therethrough. With such a construction, with the engagement member integral with the retention portion, there is no need for any alignment guides.

FIG. 9 shows an implementation having an engagement portion integral with a retention portion. A retention portion 920 has a generally planar, optionally disk-shaped structure 925 with an engagement portion 910 at the center of the structure 925 and extending therefrom. The engagement portion has two toothed shafts 913. The two toothed shafts 913 define a hollow volume therebetween, this volume extending to the generally planar structure 925 and defining an aperture 950, which may be a self-centering, self-aligning and/or self-orientating shaped aperture.

The above specification and examples provide a complete description of the structure, features and use of exemplary implementations of the invention. Since many implementations of the invention can be made without departing from the spirit and scope of the invention, the invention resides in the claims hereinafter appended. Furthermore, structural features of the different implementations may be combined in yet another implementation without departing from the disclosure and the recited claims.

What is claimed is:

1. A packaging product comprising:

a first planar retention portion having a first receiver hole, a second planar retention portion having a second receiver hole, an engagement member configured to be received through the first receiver hole and the second receiver hole, the engagement member having a flange with a diameter greater than the receiver holes and a shaft having at least two cantilevered members extending from the flange, the members having free distal ends at an end opposite the flange, the engagement member having a non-threaded engagement with the first planar retention portion and the second planar retention portion, and a tubular security member for engaging with the cantilevered members at the distal ends.

2. The packaging product of claim 1, wherein the first planar retention portion and the second planar retention portion are generally circular.

3. The packaging product of claim 2, wherein at least one of the first planar retention portion and the second planar retention portion has an area removed from the retention portion.

4. The packing product of claim 3, wherein the removed area is at a circumferential edge of the retention portion.

5. The packaging product of claim 1, wherein at least one of the first planar retention portion and the second planar retention portion is non-circular.

6. The packaging product of claim 1, wherein at least one of the cantilevered members includes teeth on an exterior surface.

7. The packaging product of claim 1, wherein the engagement member includes a teardrop shaped aperture.

8. A packaging product comprising:

a first planar retention portion having a first receiver hole, a second planar retention portion having a second receiver hole, an engagement member configured to be received through the first receiver hole and the second receiver hole, the engagement member having a flanged base with a diameter greater than the receiver holes and with a hollow toothed shaft extending from the base, and a tubular security member for engaging with the engagement member at an end opposite the flange, the engagement member having a teardrop shaped aperture.

9. The packaging product of claim 8, wherein the toothed shaft of the engagement member includes a first member and a second member extending from the base and defining the hollow toothed shaft.

10. The packaging product of claim 9, wherein the first member and the second member each occupy an arc about 90 degrees.

11. The packaging product of claim 8, wherein the first planar retention portion and the second planar retention portion are generally circular.

12. The packaging product of claim 8, wherein at least one of the first planar retention portion and the second planar retention portion has an area removed from the retention portion.

13. The packing product of claim 12, wherein the removed area is at a circumferential edge of the retention portion.

14. A packaging product comprising:

a first planar retention portion having a teardrop-apertured engagement member thereon having a hollow engagement member shaft extending perpendicularly therefrom, a second planar retention portion having a receiver hole, the engagement member shaft configured to be received through the receiver hole, the engagement member shaft having a non-threaded engagement with the second planar retention portion, and a tubular security member for engaging with the engagement member shaft at an end opposite the first planar retention portion.

15. The packaging product of claim 14, wherein the hollow engagement member shaft includes teeth on an exterior surface.

16. The packaging product of claim 14, wherein the hollow engagement member shaft includes a first member and a second member extending from the first planar retention portion and defining the hollow shaft.

17. The packaging product of claim 16, wherein the first member and the second member are cantilevered from the first planar retention portion and have free distal ends.

18. The packaging product of claim 14, wherein at least one of the first planar retention portion and the second planar retention portion is generally circular.

19. The packaging product of claim 18, wherein at least one of the first planar retention portion and the second planar retention portion has an area removed from the retention portion.

20. The packing product of claim 19, wherein the removed area is at a circumferential edge of the retention portion.

* * * * *